United States Patent [19]

Imhof

[11] Patent Number: 4,524,878

[45] Date of Patent: Jun. 25, 1985

[54] ASSEMBLY FOR SEALING AN ANNULAR GAP BETWEEN THE WALL OF A LARGE VESSEL AND A FLOATING COVER

[75] Inventor: Heinrich Imhof, Offenbach am Main, Fed. Rep. of Germany

[73] Assignee: Ingenieurbüro Imhof GmbH, Offenbach am Main, Fed. Rep. of Germany

[21] Appl. No.: 595,233

[22] Filed: Mar. 30, 1984

[30] Foreign Application Priority Data

Apr. 14, 1983 [DE] Fed. Rep. of Germany ..... 3313564

[51] Int. Cl.[3] ..... B65D 87/207

[52] U.S. Cl. ..... 220/224; 277/12; 277/138

[58] Field of Search ..... 277/12, 32, 138; 220/216, 221–224

[56] References Cited

U.S. PATENT DOCUMENTS

| | | | |
|---|---|---|---|
| 2,651,433 | 9/1953 | Mjellem | 220/222 |
| 3,565,279 | 2/1971 | Joor | 220/224 |
| 3,942,674 | 3/1976 | Nelson | 220/221 |
| 4,199,074 | 4/1980 | Gammell et al. | 220/221 X |

FOREIGN PATENT DOCUMENTS

| | | | |
|---|---|---|---|
| 1136276 | 9/1962 | Fed. Rep. of Germany | 220/222 |
| 491798 | 3/1954 | Italy | 220/216 |

*Primary Examiner*—Robert S. Ward

*Attorney, Agent, or Firm*—Toren, McGeady and Stanger

[57] ABSTRACT

A sealing assembly for a large tank having a generally vertical tank wall and a movable floating cover for sealing an annular gap therebetween to include an annular sealing element adapted to be pressed against the tank wall in sliding sealing engagement therewith and a plurality of spring elements fastened between the floating cover and the annular seal to apply a spring tension tending to press the annular seal against the wall, with a sealing blanket being provided which extends completely around the annular gap between the outer sealing element and the floating cover. The spring elements are composed of U-shaped spring stirrups fastened with a web end at the outer border of the floating cover and including a free spring web with whose end the outer sealing element is rigidly connected. The free spring web is supported with the sealing element and a second contact point at the tank wall with the contact point being spaced away from the sealing element in the vertical direction so that during all movement of the floating cover, the reaction forces of the tank wall acting at the contact points of the free spring webs will constantly hold the free spring webs in an upright position.

17 Claims, 12 Drawing Figures

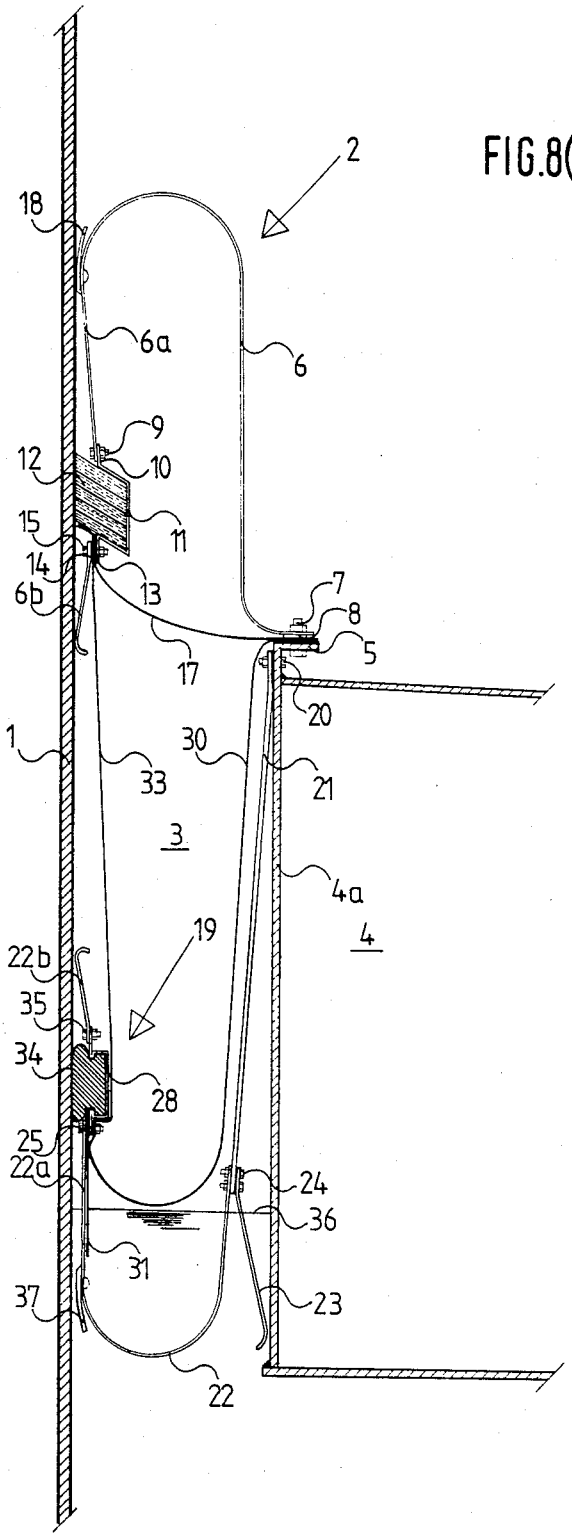
FIG.8(a)
FIG.8(b)
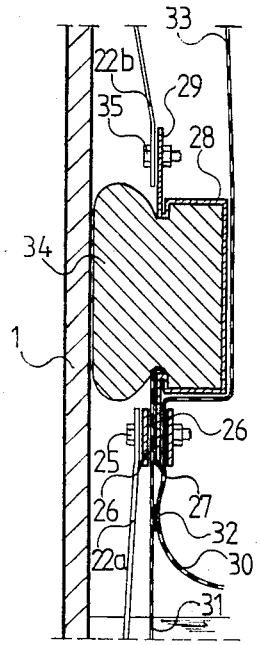

206b
217a
215
214
202
212
211
217a
201
210
209
217
207
205
204
207
208
220
203
219
218
206a
206
219

ASSEMBLY FOR SEALING AN ANNULAR GAP BETWEEN THE WALL OF A LARGE VESSEL AND A FLOATING COVER

The present invention relates to the structure of large high volume tanks or vessels which are particularly suited for use in storing volatile liquids, such as refinery products or chemicals, and which are particularly effective in preventing vaporization losses and the accumulation of dangerous vapors.

More particularly, the invention is directed toward a vessel structure, wherein a large volume vessel having a vertical wall, is provided with a floating cover for the vessel. The invention is particularly concerned with a sealing assembly for sealing an annular gap between the vertical vessel wall and the floating cover of the vessel or tank.

Sealing assemblies of the type to which the present invention relates, extending between a floating roof or cover and a tank wall, may consist of a plurality of spring elements which are fastened at the circumference of the floating cover at uniform distances adjacent one another, with the spring elements acting to span the annular gap to apply a spring tension to press an annularly closed outer sealing element against the vessel wall with the free ends of the spring elements. The annular gap is also closed or covered by means of a blanket or apron which extends around the annular gap between the outer sealing element and the floating cover.

The annular gap, which is required to enable relative vertical movement between the floating cover and the tank wall, must be sealed or closed by means of a sealing system which is capable of equalizing operational changes in the gap width as well as significant deviations from circularity in the tank wall. In performing this function, the sealing system must prevent, to the extent possible, the escape of product vapors and ingress of precipitation into the tank.

A further important function of the annular gap seal consists in the provision of a sufficient centering effect for the freely floating cover in order to ensure that its vertical movement may occur without disturbance and without overloading or tilting of the cover in certain locations.

Under ideal circumstances, the annular gap seal should be capable of exerting a uniformly strong centering action along the entire tank circumference and it should be capable of spanning even extreme local divergences in the annular gap width by means of a sufficient spring range. Furthermore, it should be capable of sliding over sharp irregularities in the tank wall in a manner free of disturbance to the extent possible without incurring excessive wear.

In the prior art, attempts have been made to meet these complex requirements in devices wherein the elastic sealing system is fastened at the outer borders of the floating cover with the sealing system being adapted to the respective annular gap width in various devices. Examples of such devices are DE-AS No. 23 58 636, wherein spring forces are utilized; Bulletin No. 3200 of the Chicago Bridge & Iron Company, 1976 involving gravitational force; U.S. Pat. No. 3,795,339, wherein inherent or internal tension is utilized; or by means of hydraulic forces as indicated in U.S. Pat. No. 4,173,291 with the gap being closed by means of a revolving flexible sealing blanket or an elastic hose filled with liquid or plastics material foam.

Contemporary annular gap seals for tanks having a floating cover are usually divided into a primary seal and a secondary seal. The primary seal faces the stored product and is intended to hold the greater portion of the product vapors. The secondary seal is outwardly directed toward the atmosphere and is basically intended to prevent the penetration of rain water or the like in addition to also operating to improve the total sealing effect. In contrast, annular gap seals of interior floating covers in tanks having a fixed roof only have as their object the limitation of product emissions.

Among newer secondary seal structures for tanks having a floating roof, there are known in the prior art basic structures which include: lip seals which are under a resilient or elastic force (U.S. Pat. No. 4,116,358); spring reinforced rubber blankets (DE-OS No. 28 32 978); lip seals of polyurethane elastomer (prospectus EKT 0028-3-79 of the firm Elastogran); foam material cushioning or padding which is pressed resiliently and which comprises abrasion-resistant sheathing (German patent application No. P 31 45 753.3); and resiliently pressed elastic packings having water stripping action (German patent application No. P 32 02 278.6).

Secondary seals which are in the form of lip seals having spring webs or legs directed at an inclination relative to the tank wall, as well as spring reinforced rubber blankets or lip seals which span the annular gap accompanied by elastic bending, tend to be easily tilted or overturned downwardly by means of horizontally extending obstacles and, therefore, fail to adequately seal against precipitation entering into the annular gap under such conditions.

The older, previously unpublished German patent application No. P 31 45 753.3 describes a secondary seal having a bulky sealing element which is rounded on all sides having spring webs terminating approximately vertically and close to the tank wall. The danger of overturning is eliminated in this construction.

The demand of tank manufacturers for secondary seals having a particularly high sealing action which will seal against precipitation entering downwardly on the inner wall of the tank during heavy rainfalls has caused the development of novel sealing elements. In the other, aforementioned, previously unpublished German patent application No. P 32 02 278.6, a sealing element is described which is capable of removing water film which runs beneath the inner wall of the tank from the tank wall with a high degree of efficiency. However, extremely good stripping action can only be ensured if the desired sealing element is capable of constantly maintaining an upright position at the tank wall.

The stripping packing which is elastically pressed against the inner wall of the tank by means of a spring force may not execute any tilting movement despite operational changes in the annular gap width and the influence of frictional forces and gliding opticals and should constantly contact the tank wall with its entire working surface and with a sufficient contact pressure force. These requirements are not adequately met by known contact pressure and guide systems. Moreover, substantial change in contact pressure forces and the angular positioning relative to the tank wall will bring about increased wear of each sealing element through excessive loading in certain locations, thereby causing frequent and rapid malfunctioning of the secondary seal.

Furthermore, two additional disadvantages of known secondary seals may also arise. In the constructions previously discussed, there may be required a determined minimum structural overall height above the upper edge of the floating roof which is dependent on the width of the annular gap and on frictional forces arising during operation and also on the rigidity of the respective spring and guide elements. However, effective structural height of the secondary seal above the upper edge of the floating roof will give rise to lost tank space and it is, therefore, to be restricted to the extent possible. Additionally, a defined height or depth of foam above the upper edge of the sealing system, which must be correspondingly increased as the structural height of the secondary seal increases, is usually required for purposes of fire prevention.

Additionally, in devices wherein a common or shared simplified construction of the primary and secondary seal is involved, the additional requirements which result may include: that the primary seal and the secondary seal be independent of each other with respect to their operation, possibly by means of a separate connection at the floating roof; that the sealing system have a low weight and operate with low frictional forces; that the secondary seal be capable of being arranged at as low a location as possible; that the primary seal be immersed in the stored product, possibly with a sealing element and that it should form a slight vapor space; that the entire seal should exert a good centering effect on the floating roof or cover, but should also be capable of gliding easily over irregularities without causing significant wear; and that an increase in the centering action, for example, by means of narrowing the annular gap, should not operate to automatically effect an increase in the contact pressure forces against the sealing element.

In a known annular gap seal of the type described in DE-AS No. 23 58 636, slender spring webs which are supported above and below in a V-shaped manner against the tank wall, in order to press against the outer sealing elements for the primary and the secondary seal, are utilized. The V-shaped pressure springs or counterpressure springs and the primary seal blanket can only be fastened at the vertical side wall of the floating cover. This is considered undesirable since leaks may occur due to the bore holes which are required for this purpose, thereby enabling a liquid or vapor of the stored product to penetrate into the hollow space of the floating body. Moreover, the relatively narrow outer sealing element which has a relatively thin line of contact and a merely punctiform contact pressure through the ends of the spring webs, cannot produce good sealing action. Additionally, in spite of its large structural height, the spring arms which are directed at an acute angle against the tank wall with stretched webs or legs and the narrow sealing element, may catch at the tank wall and overturn relatively easily. The glide stirrups which are drawn over the outer sealing elements in a later construction of this sealing system substantially reduce the sealing action. Water film running down the tank wall during rainfalls cannot be stripped by means of this construction of the outer sealing elements.

During a narrowing of the gap width which occurs during operation, spring forces and, accordingly, contact pressure forces of the sealing elements, tend to increase too sharply and lead to premature wear of the sealing elements. The contact height of the sealing elements changes as the gap width changes. This creates a disadvantage particularly on the primary side of the seal since the length and fastening of the primary web are to be determined according to the smallest expected gap width taking into consideration the various immersion depths of the floating cover. Under such circumstances, the primary seal may not yet dip into the stored product. Where there are medium and large gap widths, the primary seal contacts the tank wall at too high an elevation, thereby further increasing the vapor space beneath the primary seal, which is undesirable.

An unfavorable sealing action of these sealing elements may cause large quantities of product vapors to escape into the open, intermediate space between the primary blanket and the second blanket, thereby causing a large vapor reservoir for the emissions at the secondary seal. The secondary seal attains a structural height which is too large by means of the spring webs which are directed in a straight line and at an acute angle against the tank wall.

In internal floating covers or roofs which are relatively of a light construction, for example, which may be made of aluminum or plastic material, there is often only a slight height available for dimensioning the annular gap seal. Moreover, there must be taken into account, in interior floating covers, that only slight frictional forces may be created by the seal, since these structures possess considerably smaller lifting forces.

In another known seal arrangement disclosed in DE-AS No. 11 36 276, stirrup-shaped, resilient contact pressure members are provided which are fastened at the outer circumference of the floating roof or cover at one side and which engage at gliding shoes at the other side so as to be capable of swiveling. The gliding shoes may be pressed against the inner wall of the vessel by means of the resilient contact pressure members during simultaneous centering of the floating roof. Additional annular sealing elements with sharp edges and rigid profiles are fastened at the gliding shoes. When striking gliding objects at the tank wall, the sharp edged sealing elements will catch at the tank wall and the stirrup-shaped contact pressure members, which are not restricted from swinging out and which are rotatably supported will be excessively loaded and possibly deformed. The contact pressure members are designed so as to be very sturdy by means of the strong vertical forces, whereby the forces acting directly on the sealing elements increase to an undesirable degree as the gap becomes narrower.

Because of the poor gliding characteristics of this arrangement, and the undesirable increasing spring forces, there is a danger that the seal will catch at stronger gliding obstacles, such as horizontal weld seams, with enough force that the entire floating roof could tilt and remain suspended.

Accordingly, the present invention is directed to providing an arrangement for sealing the annular gap between a floating cover and a tank wall, wherein an improved contact pressure arrangement is provided with simultaneous spring, support and guide characteristics which may be employed with individual primary or secondary seals or at the seal of an interior floating roof. Furthermore, the invention seeks to provide a system which is employable in a suitable manner for combined primary-secondary sealing structures which correspond to the requirements previously discussed.

SUMMARY OF THE INVENTION

Briefly, the present invention may be described as a sealing assembly for a large tank having a generally vertical tank wall and a movable floating cover for sealing an annular gap therebetween comprising an annular outer sealing element adapted to be pressed against the tank's vertical wall in sliding, sealing engagement therewith and a plurality of spring elements fastened at the circumference of the floating cover at uniform distances adjacent each other, said spring elements spanning the annular gap and operating at the free ends thereof to press by spring tension the outer sealing element against the vertical wall. The spring elements are formed as U-shaped spring stirrups, which are constructed from narrow strips, in a manner known from DE-AS No. 11 36 276. The U-shaped spring stirrups are fastened at the outer border of the floating cover with one web end and the stirrups also include a free spring web at the end of which the outer sealing element is rigidly connected and which is rigidly supported at the tank wall with the sealing element and a second contact point, which is far removed from the sealing element in the vertical direction so that during all movements of the floating cover the reaction forces of the tank wall acting on the contact points of the free spring web constantly hold the free spring web in an upright position.

The annular gap sealing assembly, in accordance with the invention, provides several advantages which include: that the U-shaped spring stirrup cannot catch at the tank wall and overturn and thereby the sealing element remains constantly in its prescribed upright position; that the effective structural height of the secondary seal may be restricted to a required minimum for removing precipitation; that the sealing element will always remain at the same vertical location or height; that the U-shaped spring stirrup can equalize or compensate large changes in gap width without causing a great change in the spring forces; that a considerable part of the spring forces is used solely for centering the floating cover with wear on the sealing elements remaining, accordingly, limited due to careful contact pressure; that the spring stirrups glide at the tank wall and effect an additional grounding of the floating cover; and that the total arrangement has good gliding characteristics at the tank wall.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DESCRIPTION OF THE DRAWINGS

In the drawings:

FIG. 8 is a sectional view showing a sealing assembly comprising a shared construction for a primary and a secondary seal;

FIG. 8*a* is a detailed sectional view showing part 19 of FIG. 8 in greater detail;

DETAILED DESCRIPTION OF THE PREFERRED EMBODIMENTS

Figure 1:
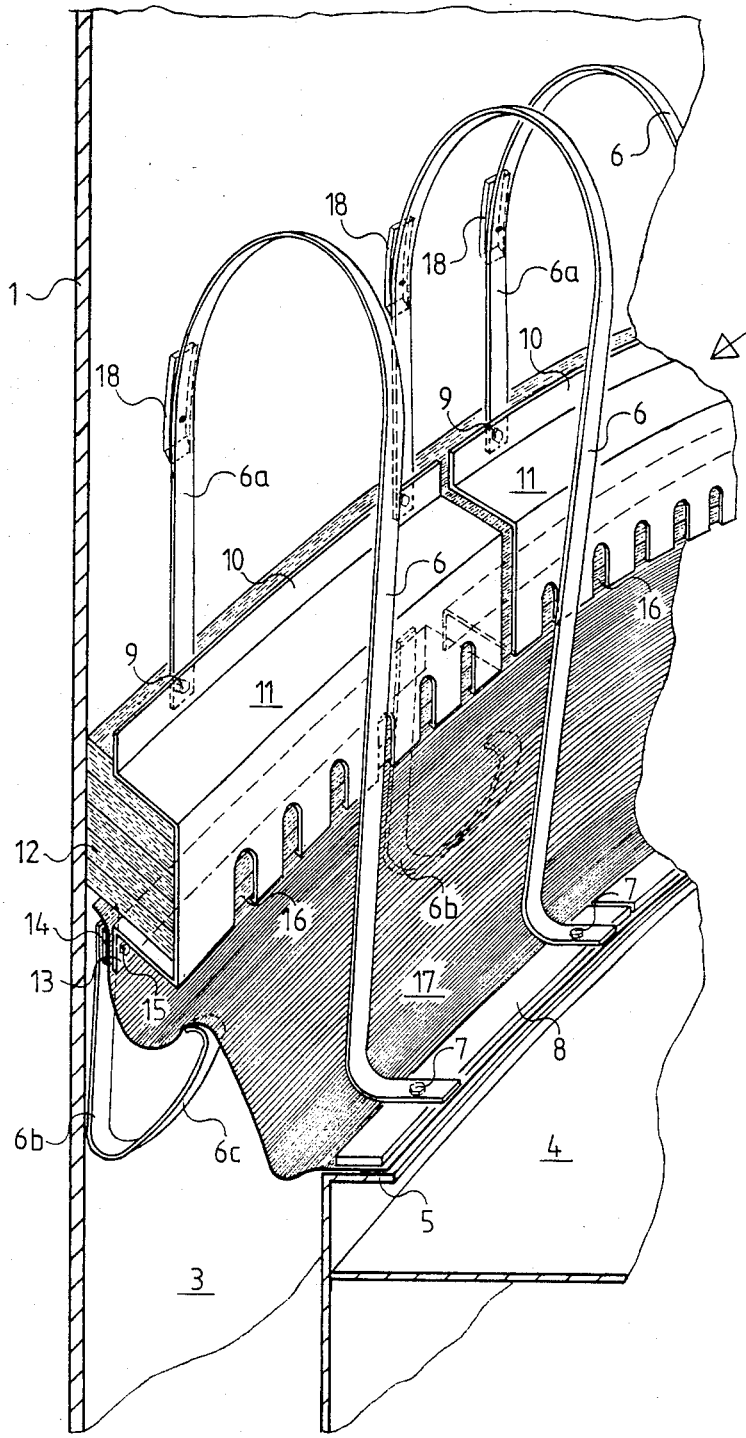
FIG. 1 is a perspective sectional view showing a secondary seal in accordance with the present invention utilized at a tank having a floating roof with a water stripping sealing element.

Referring now to the drawings and more particularly to FIG. 1, there is shown a structure for a secondary seal in accordance with the present invention which operates to provide an annular sealing assembly between an annular gap 3 which exists between the vertical wall 1 of a vessel and a floating roof or cover 4.

The vertical tank wall 1 is contacted by the annular gap sealing assembly, which is generally designated by the reference numeral 2. The annular gap seal 2 spans the annular gap 3 between the vessel 1 and the floating roof or cover 4.

The annular gap seal 2 which is depicted in FIG. 1 is employed with a conventional primary seal (not shown). The assembly 2 comprises a plurality of spring elements which consist of U-shaped spring stirrups 6 which are fastened at a horizontally inwardly directed flange 5 of the floating roof 4 by means of screws 7 with intermediary fastening strips 8 being provided. The stirrups or spring elements 6 are formed to include free webs 6*a* which are fastened at vertically upwardly directed flanges 10 of a C-shaped receiving section 11 by means of screws 9. In each instance, approximately two to four spring stirrups 6 are connected with a receiving section 11.

The receiving sections 11 open toward the tank wall 1 and have mounted therein a stripping sealing element 12 which is pressed by the sections 11 against the tank wall 1 in tight engagement therewith.

The spring elements of the invention include extension arms 6*b* of the free spring webs 6*a* and a sealing blanket 17 extends continuously around the entire annular gap. The extension arms 6*b* are fastened at a second, vertically downwardly directed flange 13 of the receiving sections 11 by means of fastening strips 12 and screws 15. The C-shaped receiving sections 11 are perforated at the rear thereof to form perforations 16. Short gliding runners 18 are attached in the upper areas of the free spring webs 6*a*.

In accordance with the respective vertical movement of the floating roof 4, the contact pressure forces of the spring stirrups 6 are distributed to the sealing element 12 and the vertical extreme points of the free spring webs 6*a* relative to the tank wall, formed by means of the extension arms 6*b* and the gliding runners 18. Precipitation running down the tank wall 1 is received by the sealing element 12 and delivered to the perforations 16 of the receiving sections 11. From there, the precipitation is removed to the floating roof 4 by means of sealing blanket 17.

The U-shaped spring stirrups 6 are produced from narrow strips of a non-rusting spring band steel. The extension arms 6*b* of the free spring webs 6*a* are produced from non-sparking metal (e.g., brass) and they are constructed so as to have a V-shape, wherein webs *6c* which are guided back at an upward inclination support the revolving sealing blanket 17 as the annular gap 3 becomes narrower. Thus, the water stripped from the tank wall 1 cannot be accumulated on the sealing blanket 17 in large quantities.

The gliding runners 18 fastened at the free spring webs *6a* are likewise produced from non-sparking metal.

Figure 2:
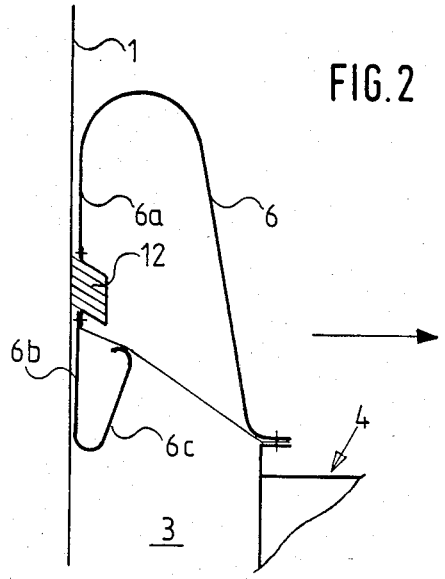
FIGS. 2–5 are schematic side views showing the secondary seal of FIG. 1 illustrated at different operating positions.
Figure 3:
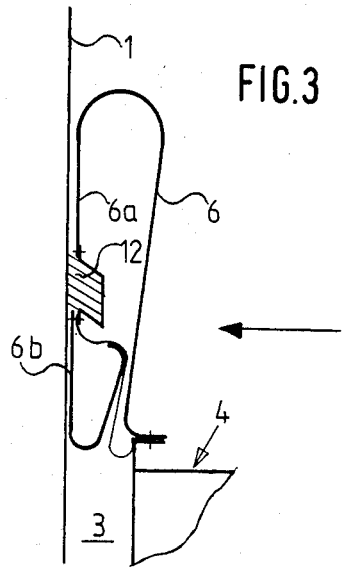
Figure 4:
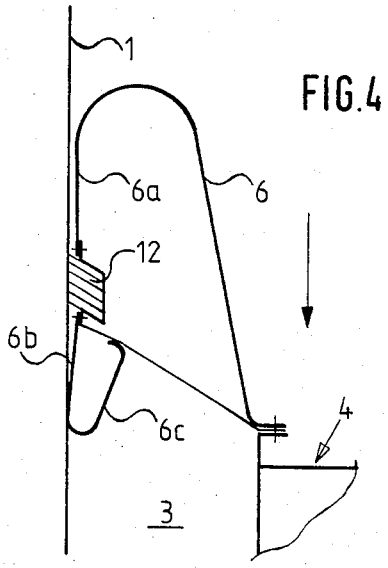

The manner of operation and functioning of the U-shaped spring stirrups 6 can be best seen from the schematic diagrams of FIGS. 2–5. In FIG. 2, there is shown the shape of a spring stirrup when the gap 3 is extremely wide, the cover or floating roof 4 having moved in the direction of the arrow. FIG. 3 shows the shape of the spring stirrup when the gap 3 becomes extremely narrow as a result of roof movement in the direction of the arrow. FIG. 4 depicts the position of a spring stirrup during downward movement of the floating roof 4 as indicated by the arrow and in FIG. 5 there is depicted the situation when the roof 4 moves upwardly, again indicated by the arrow.

Due to the friction forces which occur between the sealing element 12 and the tank wall 1, a slight spreading of the U-shaped spring stirrup occurs. The lower end of the free spring web *6b* is thereby pressed against the tank wall in the condition depicted in FIG. 4 and this operates to reduce contact pressure force between the tank wall and the sealing element thereby to prevent further spreading of the spring stirrup.

Figure 5:
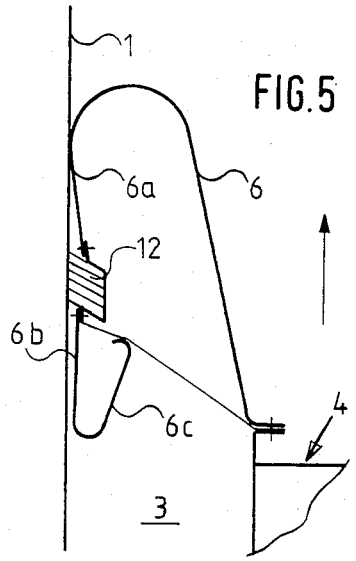

In the position shown in FIG. 5, during upward movement of the floating roof, the friction between the tank wall 1 and the sealing element 12 will cause the spring stirrup 6 to be pressed together. The upper end of the free spring web *6a* will achieve contact with the tank wall and thereby reduce the contact pressure force against the sealing element 12. The friction forces between the tank wall and the sealing element are thereby reduced and further compression of the spring stirrup is prevented.

The sealing element which is fastened at the free spring web *6a* will undergo only a slight change in position during all the relative movements of the floating roof 4 relative to the tank wall. The action of the sealing element is thus not impaired. FIGS. 2–5 indicate the different movement directions of the floating roof 4 by means of the corresponding arrows.

Figure 6:
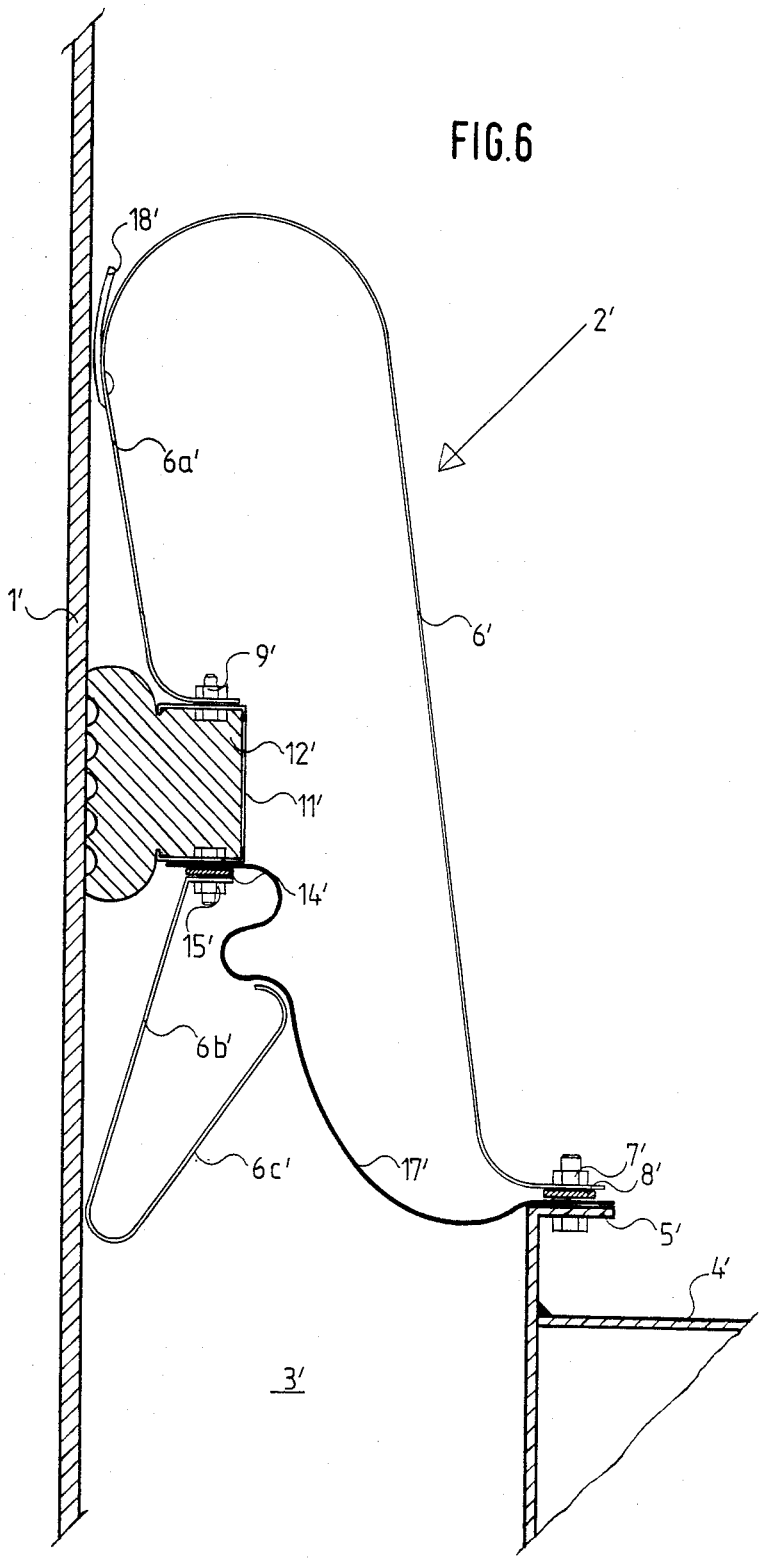
FIG. 6 is a sectional view showing another embodiment of a secondary seal in accordance with the present invention.

Referring now to FIG. 6, there is shown another embodiment of a sealing assembly 2' which comprises a secondary seal for a tank having a floating roof with a vapor-tight, elastic sealing element 12', with the sealing element 12' being determined primarily for restricting product emissions. The primary seal arranged below is not shown and comparable structural component parts are designated by reference numerals similar to those shown in FIG. 1 which are primed.

The sealing element 12', which extends around the entire annular gap 3', is pressed against the tank wall 1' in a continuous manner by means of individual C-shaped receiving sections 11'. The free spring webs *6a'* and their downwardly directed extension arms *6b'* are fastened at horizontal webs of the C-shaped receiving sections 11' by means of screws 9' and 15' wherein, in each instance, approximately two to four spring stirrups 6' are connected with a receiving section 11'.

The sealing blanket 17' which extends around the annular gap 3' circumferentially of the roof 4' is fastened at the lower web of the receiving sections 11' by means of fastening strips 14' and screws 15'. The reaction forces of the tank wall 1' acting on the extreme vertical points of the free spring webs *6a'* and *6b'* hold the sealing element 12' which is equipped with several sealing lips arranged one above the other in a constant upright position.

Figure 7:
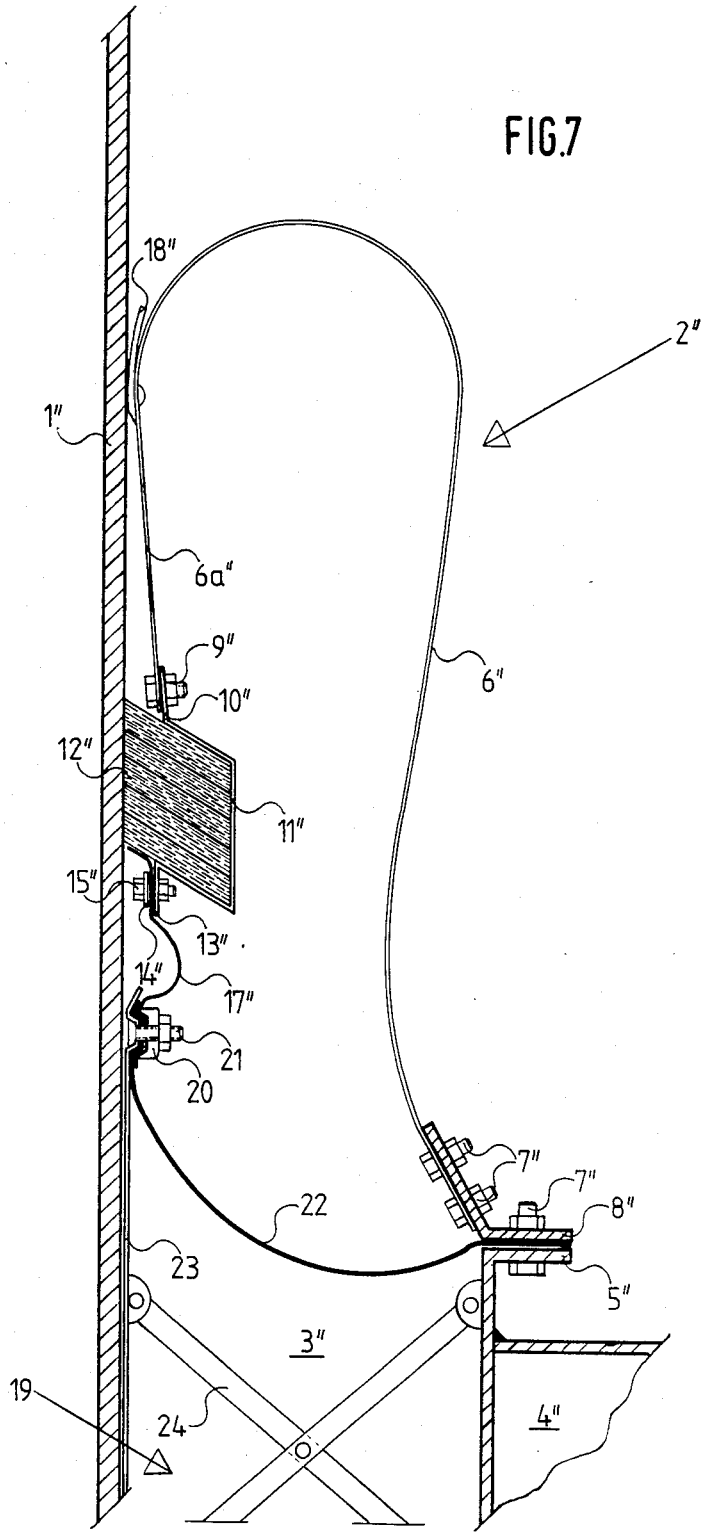
FIG. 7 is a sectional view showing another embodiment of a sealing assembly in accordance with the present invention wherein a water stripping sealing element is structurally connected with a conventional primary seal.

Referring now to FIG. 7, there is shown therein another embodiment of the invention, wherein the construction of a secondary seal 2' with a water stripping sealing element 12' is provided in association with a conventional primary seal 19. Comparable structural components are designated in FIG. 7 with reference numerals similar to those used in FIG. 1, but with a double prime added. The U-shaped spring stirrups 6'' are fastened together with the sealing blanket 22 of the primary seal 19 at a horizontal flange 5'' of the floating roof 4'' by means of angled fastening strips 8'' and screws 7''. The sealing blanket 17'' of the secondary seal 2'' is connected on one side with the lower flange 13'' of the C-shaped receiving sections 11'' and on its other side with the sealing blanket 22 of the primary seal 19 at the upper end of the gliding plates 23 by means of fastening strips 20 and screws 21. The gliding plates 23 of the primary seal 19 are connected with the outer border of the floating roof 4'' so as to be horizontally movable by means of articulated scissor joints 24. In each instance, between two and four spring stirrups 6'' are connected with a receiving section 11''.

The free spring webs *6a''* which are in contact with the tank wall 1'' are not formed with lengthening extensions beneath the receiving sections 11''. During downward movement of the floating roof 4'', the sealing blanket 17'' stretches due to friction between the tank wall 1'' and the sealing element 12'' and there is thus prevented further bending of the spring stirrup 6''. During upward movement of the floating roof 4'', the upper part of the free spring webs *6a''*, through contact of the gliding runners 18'' at the tank wall, will prevent further pressing together of the spring stirrups 6'' because of reduced friction forces. Water removed from the tank wall 1'' by means of the water stripping sealing element 12'' runs over the sealing blanket 22 of the primary seal 19 onto the floating roof 4''. It is advantageous that the height of the sealing blanket 17'' be dimensioned in such a manner that the secondary seal 2'' will be in constant unimpeded contact with the tank wall 1'' even during faulty fitting of the primary seal 19 at the tank wall 1''. The sealing element 12'' should simultaneously contact tank wall 1'' as low as possible with respect to the vertical positioning of the floating roof 4''.

A further embodiment of the invention is shown in FIG. 8, wherein there is provided a shared construction of a primary seal 19 and a secondary seal 2 of a tank having a floating roof. Structural component parts which are comparable to the secondary seal shown in FIG. 1 are designated with the same reference numerals. The sealing blanket 17 and the spring stirrup 6 of the secondary seal 2 are fastened at the flange 5 of the floating roof 4 with the flange 5 being directed horizontally with respect to the tank's center and with the connection being effected by means of screws 7 and fastening strips 8. Short receiving sections 11 are screwed at approximately vertically upwardly directed flanges 10 at the free spring webs *6a* of the spring stirrups 6 by means of screws 9 and a water stripping sealing element 12 is pressed against the tank wall 1 by the spring pressure.

Approximately between two and four spring stirrups 6 are, in each instance, connected with a receiving section 11.

Resilient lengthening or extension arms 21 of the primary seal 19 are fastened at the upper end of the side wall 4*a* of the floating roof 4 by means of screws 20. A U-shaped spring stirrup 22 and another one-armed spring stirrup 23 are fastened at the lower free end of each of the extension arms 21 by means of screw connections 24. At the upper end of a spring web 22*a*, directed toward the tank wall 1, a sealing blanket 30 with a separate immersion strip 31 welded on at 32 is threadedly connected by means of screws 25 and fastening strips 26 at vertically downwardly directed flanges 27 of short receiving sections 28. It will be noted that this construction is shown in greater detail in FIG. 8*a*. Runner or skid-like extension arms 22*b* of the spring webs 22*a* are fastened at upper vertically directed flanges 29 of the receiving sections 28 by means of screws 35. In each instance, approximately between two and four spring stirrups 22 are connected with a receiving section 28.

From the fastening point beneath the receiving section 28, the sealing blanket 30 of the primary seal 19 extends upwardly in the form of a connecting blanket 33 which loops around the primary seal 19 and is clamped so as to be airtight at the lower, vertical flanges 13 of the receiving section 11 of the secondary seal 2 together with the runner-like lengthening or extension arms 6*b* of the spring webs 6*a* by means of fastening strips 14 and screws 15. An elastic sealing element 34 is held in the receiving sections 28 in fixed engagement and extends along the circumference of the tank in close abutment therewith. The sealing blanket 30 is connected with the elastic sealing element 34 so as to be airtight by means of separate welded immersion strips 31. The vapor space which is created between the side wall 4*a* of the floating roof 4, the sealing blanket 30, the immersion strip 31 and the level 36 of the stored product is thereby sealed so as to be absolutely airtight. The connecting blanket 33 between the primary seal 19 and the secondary seal 2 produces a large space which is free of gaseous product between the two sealing systems and which forms a connection between the primary seal and the secondary seal, this connection being capable of bearing tension.

Since the U-shaped spring stirrups of the primary seal and of the secondary seal are directed against one another and since these spring stirrups have a lower gliding resistance during vertical movement of the floating roof in the direction of the spring apex or crown, the connecting blanket 33, which is capable of bearing tension, becomes a securing element during sliding disturbances of one of the two seals. Accordingly, the connecting blanket 33 has the same effect as the extension arms 6*b* and 22*b* of the spring webs 6*a* and 22*a* contacting the tank wall and it is possible that it may be capable of replacing them. The spring stirrups 23 support the spring forces of the spring stirrups 22 and of the extension arms 21.

Because of their slight angular change, the extension arms 21 can be produced from normal or standard steel. The spring stirrups 22, 23 and 6 are preferably produced from non-rusting spring band steel and the receiving sections 28 and 11 are made of non-rusting steel. The gliding runners 37 and 18 fastened at the spring stirrups 22 and 6, and the extension arms 22*b* and 6*b* of the springs webs 22*a* and 6*a*, are produced from non-sparking metal.

The sealing blankets 30, 31, 33 and 17 are composed of corresponding product-resistant and weather or corrosion-resistant plastic material having web reinforcement. Moreover, the sealing elements 34 and 12 must be sufficiently resistant to frictional forces at the tank wall.

The primary seal should be dimensioned in such a way that the sealing element is located to provide a sealing function closely above the liquid level 36 at the time that the floating roof 4 moves to its lowest position. Furthermore, it is preferable for the secondary seal to be dimensioned in such a manner that the sealing element 12 be in contact with the tank wall 1 at the least possible distance or height above the floating roof 4 so that water stripped from the tank wall 1 can continue to be removed to the floating roof.

Figure 9:
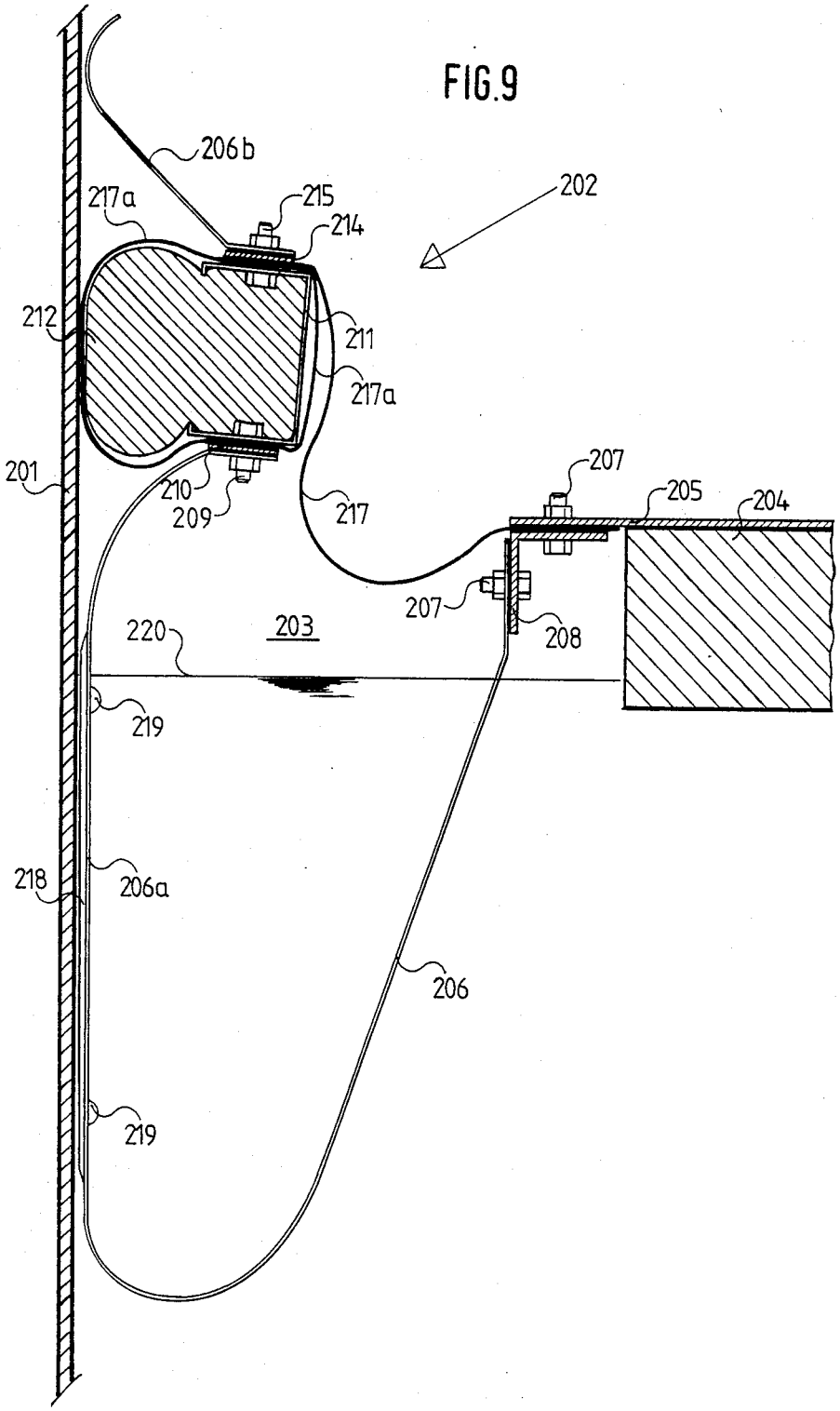
FIG. 9 is a sectional view showing an annular gap seal for an interior floating roof of a tank having a fixed roof.

In the embodiment depicted in FIG. 9, there is provided an annular gap seal 202 for an interior floating roof 204 having an extremely low construction height. The sealing blanket 217 revolving or extending around the entire annular gap 203 and the narrow, U-shaped spring stirrups 206 are fastened at the outer, upper border 205 of the interior floating cover 204 by means of clamping angles 208 and screws 207. Contact strips 218 are riveted at 219 onto the free webs 206*a* of the spring stirrups 206 so as to contact the tank wall 201. The spring stirrups 206 extend to beneath the surface 220 of the stored product from the fastening point at the interior floating cover 204. The free spring webs 206 are bent away from the tank wall 201 above the product level 220 and they are screwed together with the receiving sections 211 by means of fastening strips 210 and screws 209.

Foam material elements 212 are held within C-shaped receiving sections 211 in a fixed manner. The sealing blanket 217 includes an outer part 217*a* which is looped to extend around the receiving sections 211 and around the foam material elements 212 so that there is a completely sealed outer sealing member. The receiving sections 211, the sealing blanket 217 and the extension arms 206*b* of the free spring webs 206*a* are securely connected at the upper web of the receiving sections 211 by means of fastening strips 214 and screws 215.

The contact strips 218 and the extension arms 206*b* of the free spring webs 206*a* are made from non-sparking metal. It is preferable for non-rusting spring band steel to be used as the material for the spring stirrups 206. During vertical movement of the interior floating cover 204, tilting of the annular gap seal 202 which may be brought about by the frictional forces between the tank wall 201 and the sealing blanket 217*a* will be limited as a result of the contact of the extreme vertical points of the free spring webs 206*a*, 206*b* with the tank wall 201. The free spring webs 206*a*, 206*b* transmit a part of their spring forces directly to the tank wall 201, thereby achieving a good centering effect upon the interior of the floating cover 204 and simultaneously maintaining wear upon the sealing blanket 217*a* to a small amount. There may be provided between two and four spring stirrups 206 connected in each instance with a receiving section 211.

Figure 10:
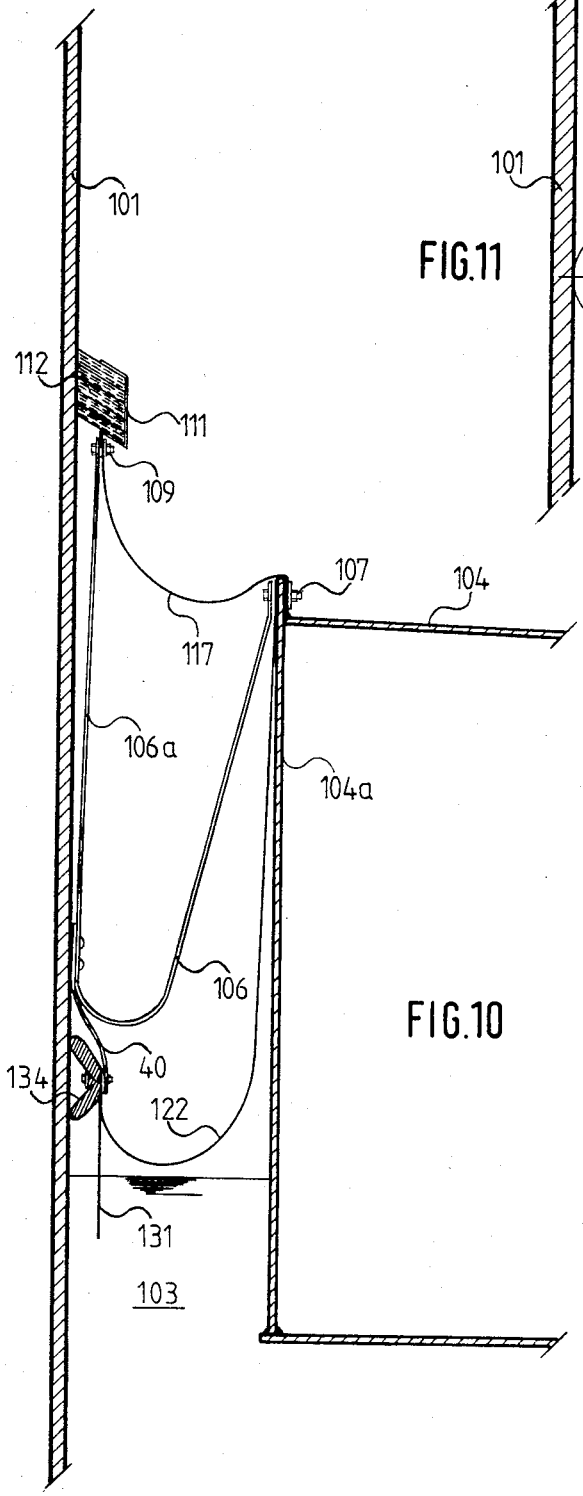
FIG. 10 is a sectional view showing another embodiment of the invention wherein a shared construction for a primary and a secondary seal is provided.

The embodiment depicted in FIG. 10 relates to a simplified structure for a device comprising a shared primary-secondary seal construction for a tank with a floating roof. In the embodiment of FIG. 10, upwardly opening U-shaped spring stirrups 106 are arranged in the annular gap 103 between the floating roof 104 and the tank wall 101. The spring stirrups 106 are fastened at a vertical flange border of the side wall 104*a* of the floating roof accompanied by simultaneous clamping of the borders of a secondary sealing blanket 117 and a primary sealing blanket 122 by means of screws 107. The upper end of the free web 106 of each spring stirrup 106 is securely connected by means of a screw 109 with a downwardly directed flange of a C-shaped receiving section 111 which opens toward the tank wall with the outer border of the secondary sealing blanket 117 also being clamped or secured by the screw 109.

The receiving sections 111, which are arranged annularly around the complete circumference of the tank with small intermediate spaces, operate to hold a secondary sealing element 112 which is pressed against the tank wall 101 to provide a water stripping function. Again, between two and four spring stirrups 106 may in each instance be connected with each receiving section 111.

An additional spring member 40 which is bent away from the tank wall 101 and which faces downwardly is fastened by means of rivets or the like with each of the spring stirrups 106. A primary sealing element 134 is provided which resiliently contacts the tank wall 101 and is attached by screws at the free ends of the springs 40 together with the outer border of the primary sealing blanket 122 and an immersion strip 131.

The differences in this construction essentially involve the fact that the spring stirrups 106 always contact the tank wall with their free webs **106*a* in the vicinity of the apex areas which are bent away from the tank wall 101, whereby the spring stirrups 106 will exert substantial centering forces on the floating roof 104 without increasing the forces tending to enhance the sealing contact of the sealing elements 112 and 134** against the tank wall.

Figure 11:
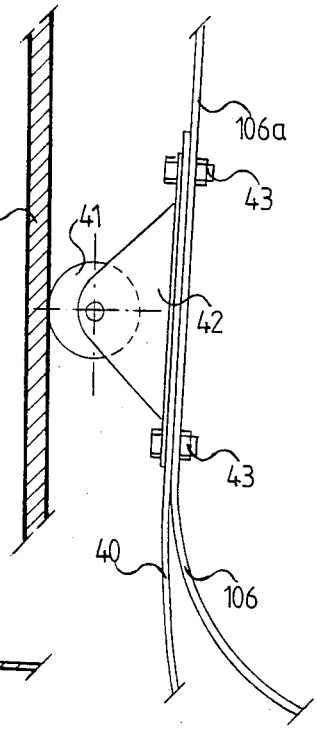
FIG. 11 is a sectional view showing a further embodiment of the invention.

As already described with respect to the other embodiments herein, gliding stirrups which are preferably made of non-sparking material may be fastened at the spring stirrups 106 at the contact points with the tank wall 101. However, in a case where strong frictional forces of the spring stirrups 106 at the tank wall 101 may be undesirable, for example, with coated tank walls, an embodiment such as that depicted in FIG. 11 may be utilized, wherein rollers 41 may be fastened at each spring stirrup as shown in FIG. 11. By this construction, gliding friction will be reduced at the contact points and only substantially slighter rolling friction will occur thereby considerably reducing the wear. The rollers 41 are fastened by screws 43 at the free webs 106 of the spring stirrups in each instance by means of a bearing block 42.

Corresponding rollers may, of course, be provided at the tank wall contact points of the other embodiments previously described.

Thus, from the foregoing, it will be seen that the present invention is essentially directed toward providing an annular gap seal for tanks or vessels having rather large volumes, wherein U-shaped spring stirrups 6 are provided which may span the annular gap 3 between the vessel wall 1 and the floating cover 4 to apply spring tension with the spring stirrups being connected securely with the outer sealing element at ends of the free spring webs **6*a* thereof. The free spring webs 6*a* are supported at the vessel wall and their length is dimensioned in such a manner that they will constantly maintain their upright position with respect to the vessel wall during all movements of the floating cover as a result of the reaction forces at the vessel wall 1** acting at their extreme points. The spring stirrups supported directly at the vessel wall apply considerable centering forces on the floating cover and they, however, carefully press against the sealing element in the substantially constant position at the vessel wall. The arrangement is particularly suitable for secondary seals as well as for combinations of secondary and primary seals and is constructed so that there will be only a slight structural height above the floating cover or roof.

While specific embodiments of the invention have been shown and described in detail to illustrate the application of the inventive principles, it will be understood that the invention may be embodied otherwise without departing from such principles.

What is claimed is:

1. A sealing assembly for a large tank having a generally vertical tank wall and a movable floating cover for sealing an annular gap therebetween, comprising:

an annular outer sealing element adapted to be pressed against said tank vertical wall in sliding sealing engagement therewith;

a plurality of spring elements fastened at the circumference of said floating cover at uniform distances adjacent each other, said spring elements spanning said annular gap and operating at the free ends thereof to press by spring tension said outer sealing element against said vertical walls;

a sealing blanket which extends completely around said annular gap between said outer sealing element and said floating cover to cover said annular gap;

said spring elements being comprised of U-shaped spring stirrups produced from narrow strips and being fastened with a web end at the outer border of said floating cover;

said spring stirrups including a free spring web with whose end said outer sealing element is rigidly connected, said free spring web being supported with said sealing element and a second contact point at said tank wall;

said contact point being spaced away from said sealing element in the vertical direction so that during all movements of said floating cover, the reaction forces of said tank wall acting at said contact points of said free spring webs constantly hold said free spring webs in a constant upright position.

2. An assembly according to claim 1, wherein said spring elements further comprising extension arms connected with said sealing element to operate to extend the length of said free spring webs.

3. An assembly according to claim 1, wherein said sealing assembly is utilized to operate as a secondary seal for said tank and wherein said free spring webs are guided downwardly to a sufficient distance that the difference in height between said sealing element and said floating cover operates to be sufficient to remove water from said tank wall to said floating cover.

4. An assembly according to claim 2, wherein said extension arms of said free spring webs are formed with a bent configuration upwardly inclined operating to support said sealing blanket when said annular gap is narrowed.

5. An assembly according to claim 1, wherein said sealing assembly is structured to provide both a primary seal and a secondary seal for said tank, and wherein said primary seal includes U-shaped spring stirrups and said secondary seal includes U-shaped spring stirrups with said U-shaped spring stirrups of said primary seal and said U-shaped spring stirrups of said secondary seal being aligned with open sides facing each other.

6. An assembly according to claim 5, further comprising a sealing element for said primary seal and a sealing element for said secondary seal and a connecting blanket which is utilized to extend between said sealing elements of said primary seal and secondary seal.

7. An assembly according to claim 5, further comprising a sealing element for said primary seal and a sealing element for said secondary seal and individual tension bands utilized between said sealing elements of said primary seal and said secondary seal.

8. An assembly according to claim 5, further comprising a sealing element for said primary seal and a sealing element for said secondary seal and wherein said U-shaped spring stirrups are provided so as to be employed in a shared manner for both said primary seal and said secondary seal, with said U-shaped spring stirrups opening upwardly, projecting over said floating cover with their free spring webs and reaching down deep into said annular gap with an apex thereof, said primary and secondary seal sealing elements being fastened at the ends of said free spring webs, with said ends being located far apart one from the other in the vertical direction.

9. An assembly according to claim 8, wherein said sealing element for said primary seal is pressed at said tank wall by means of separate additional springs which are fastened in the lower area of said spring stirrups and are dimensioned in such a manner that said spring stirrups are in constant contact with said tank wall.

10. An assembly according to claim 1, further comprising gliding runners attached to said spring stirrups at said contact points thereof with said tank wall.

11. An assembly according to claim 1, further comprising rollers attached with said spring stirrups at said contact points with said tank wall.

12. An assembly according to claim 1, further comprising a plurality of short receiving sections having said sealing element supported therein with said short receiving sections acting independently of each other, and with between two and four spring stirrups being connected with each of said receiving sections.

13. An assembly according to claim 12, wherein said receiving sections are provided with at least one vertically directed flange having fastened thereto said free spring webs.

14. An assembly according to claim 2, further comprising a plurality of short receiving sections having said sealing element supported therein with said short receiving sections acting independently of each other, and with between two and four spring stirrups being connected with each of said receiving sections.

15. An assembly according to claim 14, wherein said receiving sections are provided with at least one vertically directed flange having fastened thereto said extension arms.

16. An assembly according to claim 1, wherein said spring stirrups are made from non-rusting spring band steel.

17. An assembly according to claim 1, further comprising gliding parts arranged on said spring stirrups at said contact points with said tank wall, said gliding parts being made from non-sparking metal.

* * * * *